United States Patent [19]

Kincaid

[11] 4,152,782

[45] May 8, 1979

[54] DISPOSABLE GARMENT FOR WEAR BY A PERSON BEING IMMERSED IN A LIQUID

[75] Inventor: Frank Kincaid, Decatur, Ill.

[73] Assignee: Collegiate Cap and Gown Company, Champaign, Ill.

[21] Appl. No.: 518,065

[22] Filed: Oct. 25, 1974

[51] Int. Cl.[2] ..... A41D 1/22

[52] U.S. Cl. ..... 2/74

[58] Field of Search ..... 2/74, 75, 114, DIG. 7, 2/78 R, 78 B, 113

[56] References Cited

U.S. PATENT DOCUMENTS 2,799,023 7/1957 Goodman ..... 2/78 R

*Primary Examiner*—H. Hampton Hunter

*Attorney, Agent, or Firm*—Kirkland & Ellis

[57] ABSTRACT

A garment for wear by a person who is being fully immersed in a liquid, such as in a complete immersion baptism, has been provided which is lightweight, opaque and non-clinging to satisfy the requirements of comfort and modesty. The garment has a generalized shape with a bottom opening for the legs of the wearer, a top opening for the head and neck of the wearer, and armholes for the arms of the wearer. The bottom opening is restricted so as to bear against the legs of the wearer to prevent the bottom of the garment from rising as the wearer is immersed. A vent opening is formed near the top of the garment to permit air entrapped during the immersion to escape without causing the garment to expand or billow. A belt for fastening only around the front of the garment is provided for the desired cosmetic effect, without impeding the passage of air to the vent opening.

2 Claims, 6 Drawing Figures

DISPOSABLE GARMENT FOR WEAR BY A PERSON BEING IMMERSED IN A LIQUID

BACKGROUND OF THE INVENTION

1. Field of the Invention

This invention relates generally to a garment for wear by a person being immersed in a liquid, and more specifically, this invention relates to a lightweight, non-absorbent, opaque, non-woven fabric gown or robe for wear by a person being baptized by total immersion.

2. Description of the Prior Art

A number of religious denominations practice baptism by total immersion of the party in a tank of baptismal water. The garment worn by the party being baptized must meet the basic requirement of being sufficiently opaque to conceal the body of the wearer for modesty purposes. In addition, it is desirable that the garment be lightweight, easily put on and removed, and that it not cling to the body of the wearer in such a fashion as to outline the body. Also, the garment should be white in color, as white is the symbol of purity employed in this ceremony.

In order to achieve the desired opacity, prior art robes or gowns utilized in immersion baptisms have normally been of a thick material, such as a heavy cotton. While these gowns can provide the desired white color and the necessary opacity, they have many other failings. First of all, in order to achieve the desired opacity, the gown must be of a fairly thick material, which means that it is relatively heavy to begin with. Further, as these materials absorb considerable quantities of water, the garment is frequently uncomfortably heavy as the person emerges from the baptismal bath. The characteristic of water absorption also means that the gown tends to cling to the wearer, thus revealing the outline of the body which can cause some embarrassment. Still another disadvantage of these prior art gowns is that they must be laundered for subsequent wear, which not only causes expense and inconvenience, but it also means that the party being baptized wears a gown previously worn by someone else, which can cause some feelings of uneasiness for some people. In addition, until the gown absorbs sufficient water, the gown may tend to float on the water as the party descends into the baptismal bath and hence rise to immodest heights.

This latter problem is also one that plagues anyone attempting to use lighter weight materials, as the tendency to float is even greater. Further, if non-absorptive materials are utilized, this tendency to float is not overcome, as it would be in the case of a heavier water absorbing material. Also, in the case of lighter weight materials, overcoming the problem of the material tending to float still leaves the problem of air entrapped within the garment as the party descends into the baptismal bath, which causes the garment to expand or produce a "balloon" effect. Such an effect can, of course, create a somewhat ludicrous appearance which is undesirable in a serious ceremony of this sort.

Therefore, there is a very real need for a suitable gown for use in the considerably more than half a million full immersion baptisms that are performed in this country each year. Such a gown should be lightweight in order not to be a hindrance to the party being baptized. However, this lightweight gown or robe must be strong to prevent tearing, must be opaque to conceal the body of the wearer, should absorb little or no water so as to prevent an undesirable increase in the weight and to prevent clinging to the outline of the body, should be easy to put on and take off, should resist floating up as the wearer enters the baptismal bath, should prevent a "ballooning" effect from air entrapped within the gown, and should be disposable after being worn.

SUMMARY OF THE INVENTION

The present invention obviates the problems of prior art baptismal gowns or robes and satisfies all the conditions set forth in the preceding paragraph. This garment involves a unitary structure or single piece gown that is formed of a lightweight, non-absorbent, opaque non-woven fabric. (It should be noted that the use herein of the term "non-absorbent" does not refer only to the total lack of water absorption, but also to less than perfect non-absorptive characteristics that would still involve a high degree of repellance to the absorption of water.) The non-woven fabric has one side colored white to provide the desired symbolism for the ceremony, while the other side has a darker color, such as blue, to provide the desired opacity. In actual practice the colors would normally be obtained by utilizing a multi-ply non-woven fabric in which the outermost-ply is white, while the innermost ply would be the darker color.

The unitary structure or single piece gown is formed from two substantially identical panels, one forming the back and the other the front of the garment. Each of the panels is cut in a very generalized shape of the human body for the dual purposes of preserving modesty by not outlining the body shape and also permitting the use of a limited number of sizes that will cover virtually all human sizes and shapes of the people that will be utilizing the gowns. This generalized shape employs enlarged "bat wing" type arms which produce large armholes and hence greatly increase the ease with which the garment may be put on and removed. When the two panels are stitched together along the outer peripheries thereof, a garment is formed which has a bottom opening for the legs of the wearer, a top opening for the head and neck of the wearer, and armholes for the arms of the wearer. In addition, a belt section may be stitched to each side of the front panel to be tied in front of the wearer and provide a decorative belt effect.

In order to keep the bottom of the garment from rising or floating as the wearer enters the water, a restraining arrangement, such as a strip of elastic stitched around the bottom opening on the inside of the garment, is utilized. This elastic draws the garment in about the legs of the wearer and prevents it from rising during immersion.

As the party being baptized walks into the water, air is entrapped within the gown and can cause embarrassment by causing the gown to "balloon" and hence create an odd appearance. To prevent this type of occurrence, a vent slot is formed at the top of the back panel of the gown. This vent slot extends vertically downward from the top opening of the garment. At the top of the vent slot, a snap closure is provided to maintain the garment about the neck of the wearer after it has been put on. Even with the snap closure attached, the vent slot permits air entrapped within the gown to escape. It should also be noted that the belt segments are only to be fastened around the front portion of the gown, so that the passage of entrapped air to the vent slot is not hindered.

With this arrangement, a disposable baptismal gown is provided which can be discarded after wear, so that each party baptized has a new gown which does not have to be laundered. In addition, the gown is lightweight and comfortable, is completely opaque and does not cling to the body so as to preserve modesty, has a generalized shape to further preserve modesty, does not absorb water, remains strong even after immersion, provides the desired white color on the external surface, does not rise as the party wearing it is immersed, provides for the release of entrapped air to prevent "ballooning," and even provides a decorative belt that does not interfere with the escape of entrapped air.

These and other objects, advantages and features of this invention will hereinafter appear, and for purposes of illustration, but not of limitation, an exemplary embodiment of the present invention is shown in the appended drawing.

DETAILED DESCRIPTION OF THE PREFERRED EMBODIMENT

Figure 1:
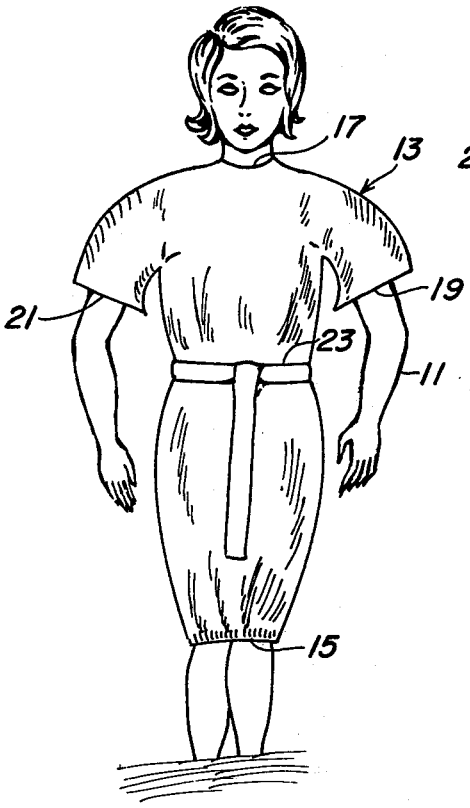
FIG. 1 is a front perspective view of the garment of this invention as worn by a party who is to be immersed in a liquid.

With reference to the drawing, FIG. 1 depicts a stylized human female 11 wearing a garment 13 constructed in accordance with the present invention. The garment 13 is to be worn by a person who is to be immersed in a liquid. More specifically, the particular utilization of this preferred embodiment is as a baptismal gown for a person who is to be baptized by total immersion in the baptismal water.

As may be seen in FIG. 1, the baptismal gown 13 is a unitary structure or single piece robe that has a bottom opening 15 for the legs of the wearer, a top opening 17 for the head and neck of the wearer, and armholes 19 and 21 for the arms of the wearer. The bottom opening 15 of the gown is pinched in about the legs of the wearer in order to prevent the bottom of the gown from rising as the wearer becomes immersed. A belt 23 is tied about the front of the gown 13 for decorative effect.

Figure 2:
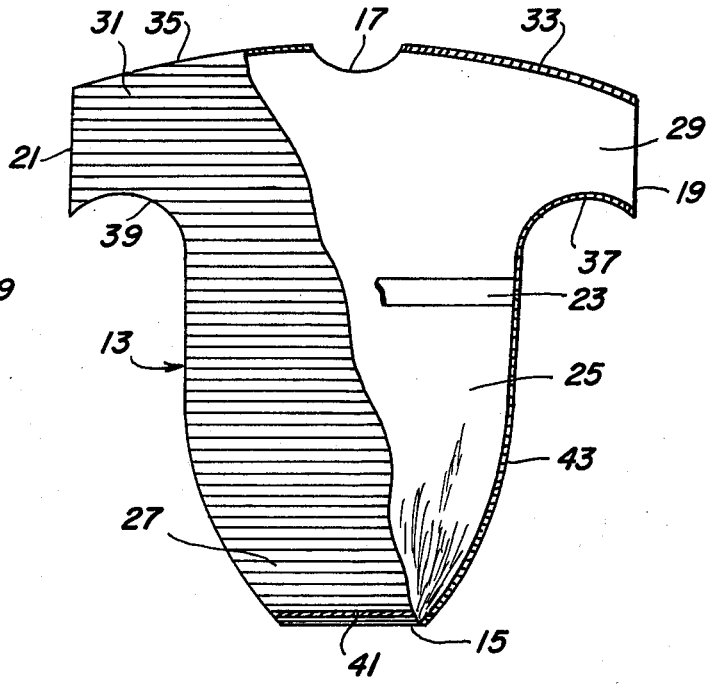
FIG. 2 is a partially broken away front elevational view of the garment of this invention.
Figure 3:
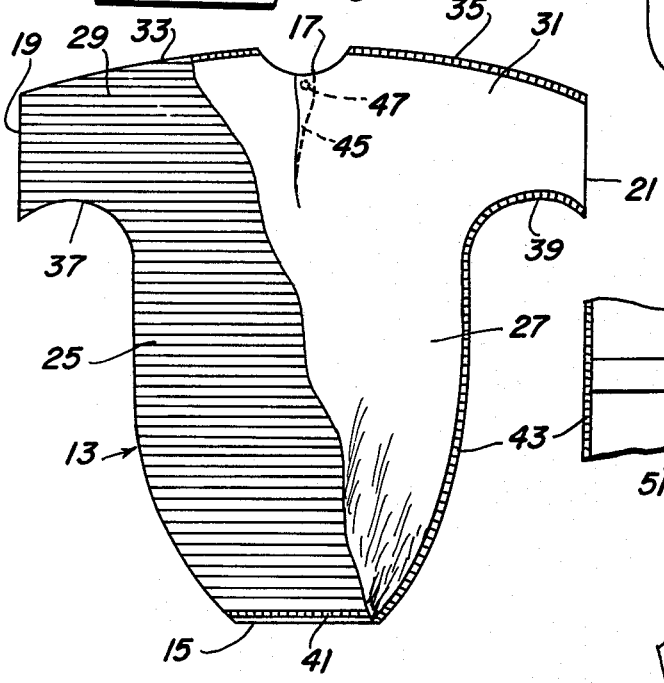
FIG. 3 is a partially broken away back elevational view of the garment of this invention.

The structure and features of the gown 13 may be better understood by reference to FIGS. 2 and 3. From these figures it may be seen that the baptismal gown 13 is formed with a front panel 25 and a back panel 27. Each of these panels is formed of a fabric that is lightweight, non-absorbent and opaque. In this particular embodiment, a non-woven fabric is utilized to yield these characteristics and yet produce the necessary strength during wear thereof. A particular example of such a non-woven fabric is marketed under the trademark "KAYCEL" by Kimberly-Clark Corporation. In this specific embodiment, Grade 6943/16 of the "KAYCEL" non-woven fabric was found to yield the desired characteristics. Of course, any other suitable material that provided the desired characteristics could be utilized.

The Grade 6943/16 "KAYCEL" non-woven fabric is a three-ply material. Such a multi-ply non-woven fabric is useful in obtaining the desired opacity to conceal the body of the wearer, as the innermost ply can be a suitable dark color. In this preferred embodiment, this innermost ply (seen on panel 27 in FIG. 2 and on panel 25 in FIG. 3) is blue. The outermost ply (seen on panel 25 in FIG. 2 and panel 27 in FIG. 3) is, of course, white to provide the desired symbol of purity in the baptismal ceremony.

As may be seen in FIGS. 2 and 3, the arms of the generalized shaped gown 13, exemplified by arm 29 of front panel 25 and arm 31 of back panel 27, are formed very large in a "bat wing" style. The shoulder lines 33 and 35 have a degree of curvature, and the armpits sections 37 and 39 are sharply curved. This produces very large armholes 19 and 21, which facilitate the ease of putting on and taking off the garment and preclude any chance of binding about the arms.

In order to keep the lightweight material from floating up as the wearer descends into the baptismal water, it is necessary to pinch the bottom of the gown 13 about the legs of the wearer, as illustrated in FIG. 1. This is achieved by utilizing a suitable restraining structure, such as a band of elastic material 41 fastened about the bottom opening 15 on the internal portion of the gown 13. This elastic material may be any suitable type of such material, such as those widely employed in the clothing field. In this preferred embodiment, the elastic material 41 is stitched to the gown 13, although any suitable method of fastening the elastic material to the gown may be utilized.

It should be noted that panels 25 and 27 are joined together along the outer peripheries thereof by suitable stitching 43. Again, although the stitching is the approach utilized in this preferred embodiment, any suitable approach for fastening the outer peripheries of the two panels may be employed. As may be seen, the stitching 43 is completely around the outer peripheries of the panels 25 and 27, except for the openings 15 and 17 and the armholes 19 and 21.

Figure 4:
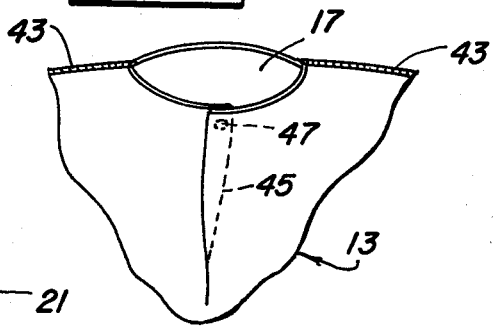
FIG. 4 is a partial back perspective view illustrating the top or neck opening and the vent slot of the garment of this invention.

With reference now specifically to FIG. 3, it may be seen that a vent opening, such as a vent slot 45 is formed at the top of the back panel 27. Slot 45 extends in a vertical direction downwardly from the top neck opening 17. The purpose of this vent slot 45 is to permit air entrapped within the gown 13 as the wearer descends into the baptismal bath to escape from the gown without causing a "ballooning" of the gown about the wearer. The vent slot 45 is formed in back panel 27 by merely cutting the material of this panel. A snap closure 47 is then placed at the top of the vent slot 45 so that after the person has donned the gown 13 it may be fastened around the neck by means of the snap closure 47. The snap closure results in an overlapping of the material on either side of the vent slot 45, and hence the slight local distortion insures that the vent slot 45 will permit entrapped air to be released. The features of the vent slot 45 and the snap closure 47 are better illustrated in the enlarged perspective view of FIG. 4.

Figure 5:
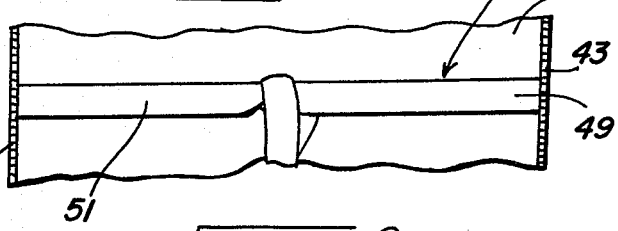
FIG. 5 is a partial front elevational view illustrating the belt of the garment of this invention.

From FIG. 5, it may be seen that the decorative belt 23 actually consists of two belt elements 49 and 51. Belt elements 49 and 51 are connected to the front panel 25 of gown 13 by the same stitching 43 that connects the peripheries of panels 25 and 27. The belt elements 49 and 51 are loosely tied at the front of the gown to provide a decorative belt effect without pulling the gown in around the waist of the wearer. It should be noted that the belt 23 is only passed around the front of the wearer, so that passage of entrapped air to vent slot 45 is not hindered by the belt.

Figure 6:
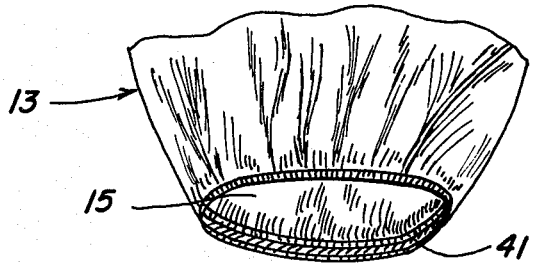
FIG. 6 is a partial perspective view illustrating the bottom opening of the garment of this invention and the elastic restraining material thereabout.

The enlarged perspective view of FIG. 6 further demonstrates in greater detail the structure of the elastic material 41, its connection to the gown 13 and how the gown 13 is distorted to provide the desired restraining effect.

It may be seen that a baptismal gown for total immersion baptism has been provided which is lightweight and comfortable for the wearer, while yet being strong enough to take the wear to which it is subjected. By reason of the large armholes 19 and 21 and the snap enclosure in combination with the vent slot 45, the garment is easily put on. After wear, the garment may be easily removed by the same fashion in which it is put on, or it may just be torn off, as the garment is intended to be disposable after one use. Since the material is non-absorbent, little or not water is absorbed by the material to increase the weight or to cause the gown 13 to mold itself to the figure of the wearer, thus preserving the fell of modesty. This modesty aspect is further enhanced by the generalized shape of the garment. Another advantage of the non-absorbent material is that water is not tracked through the church after the baptism. The desired white color of the gown is provided, while opacity is achieved by utilization of a darker color on the inner surface or ply of the material. In addition, the tendency of a lightweight material to rise in the water as the wearer is immersed, especially when the lightweight material is non-absorbent, is overcome by the restraining effect of the elastic material 41. Finally, the "ballooning" effect of entrapped air in the gown 13 is precluded by the provision of the vent slot 45 to permit escape of the entrapped air.

It should be understood that various modifications, changes and variations may be made in the arrangements, operations and details of construction of the embodiment disclosed herein without departing from the spirit and scope of this invention.

I claim:

1. A disposable gown for wear by a person being baptized by immersion comprising:

a front panel of a lightweight, non-absorbent, non-woven fabric cut to form a generalized shape of the outline of a human body from the knees to the neck with a scooped line at the neck and wide abbreviated arms, said front panel having one side colored white for external appearance and the other side having a dark color to provide opacity;

a back panel substantially identical to said front panel, said panels positioned to have the dark colored sides facing one another and being stitched together along the peripheries thereof to form a garment having a bottom opening for the legs of the wearer, a top opening for the head and neck of the wearer, and armholes for the arms of the wearer;

a band of elastic material stitched to the inner sides of said panels around said bottom opening to pinch the gown about the legs of the wearer to prevent it from rising as the wearer is immersed;

a vertical slot formed in said back panel downwardly from said top opening to permit air entrapped in the gown as the wearer is immersed to be vented without unduly expanding the gown;

a snap closure device located at the top of said vertical slot; and a belt element stitched to each side of said front panel for fastening only at the front of the gown in order not to interfere with the passage of entrapped air to said slot.

2. A disposable gown as claimed in claim 1 wherein said non-woven fabric has a multiplicity of plys, with the innermost ply colored blue and the outermost ply colored white.

* * * * *

UNITED STATES PATENT AND TRADEMARK OFFICE

CERTIFICATE OF CORRECTION

PATENT NO. : 4,152,782

DATED : May 8, 1979

INVENTOR(S) : Frank Kincaid

It is certified that error appears in the above-identified patent and that said Letters Patent are hereby corrected as shown below:

Column 5, line 25, "fell" should read --feel--.

Column 5, line 22, "not" should read --no--.

Signed and Sealed this

*Seventh* Day of *August 1979*

[SEAL]

*Attest:*

*Attesting Officer*

LUTRELLE F. PARKER

*Acting Commissioner of Patents and Trademarks*